US009605828B2

(12) United States Patent
Pickard et al.

(10) Patent No.: US 9,605,828 B2
(45) **Date of Patent: *Mar. 28, 2017**

(54) LIGHT ENGINE ASSEMBLIES

(75) Inventors: Paul Kenneth Pickard, Morrisville, NC (US); Gary David Trott, Morrisville, NC (US)

(73) Assignee: Cree, Inc., Durham, NC (US)

( * ) Notice: Subject to any disclaimer, the term of this patent is extended or adjusted under 35 U.S.C. 154(b) by 592 days.

This patent is subject to a terminal disclaimer.

(21) Appl. No.: 11/939,052

(22) Filed: Nov. 13, 2007

(65) Prior Publication Data

US 2008/0112168 A1 May 15, 2008

Related U.S. Application Data

(60) Provisional application No. 60/858,881, filed on Nov. 14, 2006.

(51) Int. Cl.
*F21S 4/00* (2016.01)
*F21V 21/00* (2006.01)
(Continued)

(52) U.S. Cl.
CPC ..... *F21S 48/15* (2013.01); *F21S 8/026* (2013.01); *F21S 48/328* (2013.01); *F21V 15/01* (2013.01); *F21V 29/004* (2013.01); *F21V 29/2212* (2013.01); *F21V 29/75* (2015.01); *F21W 2131/401* (2013.01); *F21Y 2101/00* (2013.01); *F21Y 2105/10* (2016.08); *F21Y 2115/10* (2016.08)

(58) Field of Classification Search
CPC ..... F21S 8/026; F21S 48/15; F21S 48/328; F21V 15/01; F21V 29/004; F21V 29/2212; F21V 29/75
USPC ..... 362/147, 249.02, 294, 364, 373, 800
See application file for complete search history.

(56) References Cited

U.S. PATENT DOCUMENTS 3,052,749 A 9/1962 Milton et al.
3,263,023 A 7/1966 Staley
(Continued)

FOREIGN PATENT DOCUMENTS

DE 299 21 156 5/2000
DE 203 15 543 2/2004
(Continued)

OTHER PUBLICATIONS

Cree, Inc., "Cree® Xlamp® 7090 XR-E Series LED Binning and Labeling," Application Note: CLD-AP08.000, 7pp (2006).
(Continued)

*Primary Examiner* — Jason Moon Han
(74) *Attorney, Agent, or Firm* — Burr & Brown, PLLC

(57) ABSTRACT

A light engine assembly, comprising at least one trim element, a light engine housing, and a light engine comprising at least one solid state light emitter. In some embodiments, an external surface of the light engine housing is in contact with an internal surface of the trim element. In some embodiments, the light engine assembly further comprises at least one thermal interface element positioned between and in contact with the light engine housing and the trim element. In some embodiments, the light engine assembly further comprises light engine housing fins which are in contact with the light engine housing and the trim element.

4 Claims, 6 Drawing Sheets

(51) Int. Cl.

| | |
|---|---|
| ***F21S 8/10*** | (2006.01) |
| ***F21V 29/75*** | (2015.01) |
| ***F21S 8/02*** | (2006.01) |
| ***F21V 15/01*** | (2006.01) |
| ***F21V 29/00*** | (2015.01) |
| *F21W 131/401* | (2006.01) |
| *F21Y 101/00* | (2016.01) |
| *F21Y 105/10* | (2016.01) |
| *F21Y 115/10* | (2016.01) |

(56) References Cited

U.S. PATENT DOCUMENTS

| | | | | |
|---|---|---|---|---|
| 4,689,442 | A | 8/1987 | Ozaki | |
| 5,116,689 | A | 5/1992 | Castro et al. | |
| 5,850,126 | A | 12/1998 | Kanbar | |
| 5,876,831 | A | 3/1999 | Rawal | |
| 6,045,240 | A | 4/2000 | Hochstein | |
| 6,234,648 | B1 | 5/2001 | Börner et al. | |
| 6,278,607 | B1 | 8/2001 | Moore et al. | |
| 6,340,868 | B1 | 1/2002 | Lys et al. | |
| 6,350,043 | B1 | 2/2002 | Gloisten | |
| 6,441,943 | B1 | 8/2002 | Roberts et al. | |
| 6,482,520 | B1 | 11/2002 | Tzeng | |
| 6,578,986 | B2 | 6/2003 | Swaris et al. | |
| 6,659,632 | B2 | 12/2003 | Chen | |
| 6,685,339 | B2 * | 2/2004 | Daughtry et al. | 362/249.05 |
| 6,712,486 | B1 | 3/2004 | Popovich et al. | |
| 6,740,972 | B2 | 5/2004 | Smith et al. | |
| 6,788,541 | B1 | 9/2004 | Hsiung | |
| 6,789,921 | B1 | 9/2004 | Deloy et al. | |
| 6,791,257 | B1 | 9/2004 | Sato et al. | |
| 6,800,932 | B2 | 10/2004 | Lam et al. | |
| 6,805,474 | B2 | 10/2004 | Walser et al. | |
| 6,846,093 | B2 | 1/2005 | Swaris et al. | |
| 6,853,151 | B2 * | 2/2005 | Leong et al. | 315/185 R |
| 6,864,573 | B2 | 3/2005 | Robertson et al. | |
| 6,880,954 | B2 | 4/2005 | Ollet et al. | |
| 6,949,772 | B2 | 9/2005 | Shimizu et al. | |
| 7,014,336 | B1 | 3/2006 | Ducharme et al. | |
| 7,030,486 | B1 | 4/2006 | Marshall | |
| 7,095,110 | B2 | 8/2006 | Arik et al. | |
| 7,121,688 | B2 | 10/2006 | Rempel | |
| 7,144,140 | B2 | 12/2006 | Sun et al. | |
| 7,210,832 | B2 | 5/2007 | Huang | |
| 7,213,940 | B1 | 5/2007 | Van De Ven et al. | |
| 7,226,189 | B2 | 6/2007 | Lee et al. | |
| 7,234,844 | B2 | 6/2007 | Bolta et al. | |
| 7,258,475 | B2 | 8/2007 | Kurumatani | |
| 7,284,874 | B2 | 10/2007 | Jeong et al. | |
| 2003/0218878 | A1 | 11/2003 | Swaris et al. | |
| 2004/0105247 | A1 | 6/2004 | Calvin et al. | |
| 2005/0051789 | A1 | 3/2005 | Negley et al. | |
| 2005/0077525 | A1 | 4/2005 | Lynch et al. | |
| 2005/0094105 | A1 | 5/2005 | Otsuka et al. | |
| 2005/0111234 | A1 | 5/2005 | Martin et al. | |
| 2005/0128751 | A1 | 6/2005 | Robarge et al. | |
| 2005/0168986 | A1 | 8/2005 | Wegner | |
| 2005/0174780 | A1 | 8/2005 | Park | |
| 2005/0237739 | A1 | 10/2005 | Lee et al. | |
| 2006/0061539 | A1 | 3/2006 | Song et al. | |
| 2006/0098440 | A1 | 5/2006 | Allen | |
| 2006/0187660 | A1 | 8/2006 | Liu | |
| 2007/0074755 | A1 | 4/2007 | Eberspacher et al. | |
| 2007/0079954 | A1 | 4/2007 | Wang et al. | |
| 2007/0115656 | A1 | 5/2007 | Chou et al. | |
| 2007/0137074 | A1 | 6/2007 | Van De Ven | |
| 2007/0139920 | A1 | 6/2007 | Van De Ven | |
| 2007/0139923 | A1 | 6/2007 | Negley | |
| 2007/0170447 | A1 | 7/2007 | Negley | |
| 2007/0171145 | A1 | 7/2007 | Coleman | |
| 2007/0230186 | A1 | 10/2007 | Chien | |
| 2007/0236911 | A1 | 10/2007 | Negley | |
| 2007/0247414 | A1 | 10/2007 | Roberts | |
| 2007/0247847 | A1 | 10/2007 | Villard | |
| 2007/0247851 | A1 | 10/2007 | Villard | |
| 2007/0262337 | A1 | 11/2007 | Villard | |
| 2007/0263393 | A1 | 11/2007 | Van De Ven | |
| 2007/0267983 | A1 | 11/2007 | Van De Ven | |
| 2007/0274063 | A1 | 11/2007 | Negley | |
| 2007/0274080 | A1 | 11/2007 | Negley | |
| 2007/0278503 | A1 | 12/2007 | Van De Ven | |
| 2007/0278934 | A1 | 12/2007 | Van De Ven | |
| 2007/0279440 | A1 | 12/2007 | Negley | |
| 2007/0279903 | A1 | 12/2007 | Negley | |
| 2007/0280624 | A1 | 12/2007 | Negley | |
| 2008/0084685 | A1 | 4/2008 | Van De Ven | |
| 2008/0084700 | A1 | 4/2008 | Van De Ven | |
| 2008/0084701 | A1 | 4/2008 | Van De Ven | |
| 2008/0088248 | A1 | 4/2008 | Myers | |
| 2008/0089053 | A1 | 4/2008 | Negley | |
| 2008/0106895 | A1 | 5/2008 | Van De Ven | |
| 2008/0106907 | A1 | 5/2008 | Trott | |
| 2008/0112168 | A1 | 5/2008 | Pickard | |
| 2008/0112170 | A1 | 5/2008 | Trott | |
| 2008/0130285 | A1 | 6/2008 | Negley | |
| 2008/0136313 | A1 | 6/2008 | Van De Ven | |
| 2008/0137347 | A1 | 6/2008 | Trott | |
| 2008/0192493 | A1 | 8/2008 | Villard | |
| 2008/0259589 | A1 | 10/2008 | Van De Ven | |

FOREIGN PATENT DOCUMENTS

| | | | |
|---|---|---|---|
| DE | 20315543 | 2/2004 | |
| DE | 10 2004 001 940 | 8/2005 | |
| DE | 102004001940 | 8/2005 | |
| EP | 1 174 307 | 1/2002 | |
| EP | 1 600 691 | 11/2005 | |
| EP | 1 674 792 | 6/2006 | |
| JP | 09-055457 | 2/1997 | |
| JP | 11-264668 | 9/1999 | |
| JP | 2001-036153 | 2/2001 | |
| JP | 2001-075094 | 3/2001 | |
| JP | 2003-529889 | 10/2003 | |
| JP | 3099033 U | 10/2003 | |
| JP | 2004-182071 | 7/2004 | |
| JP | 2005-158746 | 6/2005 | |
| JP | 2006-228694 | 8/2006 | |
| TW | M286407 U | 1/2006 | |
| TW | I262276 | 9/2006 | |
| TW | M297441 U | 9/2006 | |
| WO | WO 2006094346 A1 * | 9/2006 | F21S 8/02 |
| WO | 2008079161 | 7/2008 | |

OTHER PUBLICATIONS

Cree, Inc., "Cree® Xlamp® 7090 XR-E Series LED Data Sheet," Datasheet: CLD-DS05.000, 10 pp (2006).

Cree, Inc., "Cree® Xlamp® 7090 XR-E Series LED Secondary Optics," Datasheet: CLD-DS07.000, 3 pp (2004-2006).

McMaster-Carr Supply Company, "Multipurpose Aluminum (Alloy 6061), specification sheets," Retrieved Dec. 14, 2006 from www.mcmaster.com/param/asp/Psearch2.asp?regTyp=parametric &act=psearch%F . . . , 3 pp.

Japanese Office Action (from corresponding JP Application No. 2009-537309) dated Nov. 29, 2012 (and translation provided by foreign counsel).

Japanese Office Action (and translation provided by foreign counsel) from a corresponding Japanese patent application bearing a mailing date of Jul. 19, 2013, 6 pages.

* cited by examiner

LIGHT ENGINE ASSEMBLIES

CROSS-REFERENCE TO RELATED APPLICATIONS

This application claims the benefit of U.S. Provisional Patent Application No. 60/858,881, filed Nov. 14, 2006, the entirety of which is incorporated herein by reference.

FIELD OF THE INVENTION(S)

The present inventive subject matter relates to light engine assemblies for use in lighting devices, and lighting devices which include such light engine assemblies. In some embodiments, the present inventive subject matter relates to light engine assemblies which include solid state light emitters, for example, light emitting diodes.

BACKGROUND OF THE INVENTION(S)

A large proportion (some estimates are as high as twenty-five percent) of the electricity generated in the United States each year goes to lighting. Accordingly, there is an ongoing need to provide lighting which is more energy-efficient. It is well-known that incandescent light bulbs are very energy-inefficient light sources—about ninety percent of the electricity they consume is released as heat rather than light. Fluorescent light bulbs are more efficient than incandescent light bulbs (by a factor of about 10) but are still less efficient than solid state light emitters, such as light emitting diodes.

In addition, as compared to the normal lifetimes of solid state light emitters, e.g., light emitting diodes, incandescent light bulbs have relatively short lifetimes, i.e., typically about 750-1000 hours. In comparison, light emitting diodes, for example, have typical lifetimes between 50,000 and 70,000 hours. Fluorescent bulbs have longer lifetimes (e.g., 10,000-20,000 hours) than incandescent lights, but provide less favorable color reproduction.

Another issue faced by conventional light fixtures is the need to periodically replace the lighting devices (e.g., light bulbs, etc.). Such issues are particularly pronounced where access is difficult (e.g., vaulted ceilings, bridges, high buildings, traffic tunnels) and/or where change-out costs are extremely high. The typical lifetime of conventional fixtures is about 20 years, corresponding to a light-producing device usage of at least about 44,000 hours (based on usage of 6 hours per day for 20 years). Light-producing device lifetime is typically much shorter, thus creating the need for periodic change-outs.

Also, there is an ongoing need to provide lighting assemblies which can be installed and/or repaired more easily, with less modification of or damage to construction elements (e.g., ceilings, walls and floors) in which such lighting assemblies are mounted, and in which light emitters can be more easily changed.

Additionally, efforts have been ongoing to develop ways by which solid state light emitters can be used in place of incandescent lights, fluorescent lights and other light-generating devices in a wide variety of applications. In addition, where light emitting diodes (or other solid state light emitters) are already being used, efforts are ongoing to provide lighting assemblies (which include light emitting diodes or other solid state light emitters) which are improved, e.g., with respect to energy efficiency, color rendering index (CRI Ra), contrast, efficacy (lm/W), low cost, and/or duration of service.

Although the development of solid state light emitters, such as light emitting diodes, has in many ways revolutionized the lighting industry, some of the characteristics of light emitting diodes have presented challenges, some of which have not yet been fully met.

BRIEF SUMMARY OF THE INVENTION(S)

In the case of conventional recessed lighting and the like, a majority of the cans are sold for use in insulated ceilings. For example, residential recessed downlights are frequently installed in direct contact with insulation or in ceilings with little or no airflow. Most heat dissipates into the air of the room in which the downlight is installed.

The design of incandescent downlights has typically focused on maintaining the temperature of surfaces that come into contact with wood or insulation below maximum values, e.g., as specified by Underwriters Laboratories. Designers typically do not focus on the thermal management of the incandescent lamp because it is tolerant of the high temperatures typically found within incandescent downlights.

Conversely, the dissipation of heat from LEDs and other solid state light emitters within a recessed downlight is very critical. For instance, if LED junction temperatures are not maintained below manufacturers' ratings, decreased lamp life and compromised performance result.

The light engine assemblies according to the present inventive subject matter provide excellent heat dissipation, particularly in the room-side of the device.

According to a first aspect of the present inventive subject matter, there is provided a light engine assembly, comprising:

at least one trim element, the trim element defining a trim element internal space;

a light engine housing positioned within the trim element internal space, the light engine housing defining a light engine housing internal space; and a light engine comprising at least one solid state light emitter, the light engine being positioned within the light engine housing internal space, an external surface of the light engine housing being in contact with an internal surface of the trim element.

According to a second aspect of the present inventive subject matter, there is provided a light engine assembly, comprising:

at least one trim element, the trim element defining a trim element internal space;

a light engine housing positioned within the trim element internal space, the light engine housing defining a light engine housing internal space;

a light engine comprising at least one solid state light emitter, the light engine being positioned within the light engine housing internal space, and at least one thermal interface element, the thermal interface element being positioned between and in contact with each of an external surface of the light engine housing and an internal surface of the trim element.

According to a third aspect of the present inventive subject matter, there is provided a light engine assembly, comprising:

at least one trim element, the trim element defining a trim element internal space;

a light engine housing positioned within the trim element internal space, the light engine housing defining a light engine housing internal space;

a light engine comprising at least one solid state light emitter, the light engine being positioned within the light engine housing internal space; and a plurality of light engine housing fins;

each of the light engine housing fins being:

in contact with an external surface of the light engine housing, in contact with an internal surface of the trim element, outside of the light engine housing internal space, and inside of the trim element internal space.

In some embodiments according to the present inventive subject matter, the external surface of the light engine housing and the internal surface of the trim element are each substantially frustoconical. In some such embodiments, the external surface of the light engine housing and the internal surface of the trim element are each substantially circular frustoconical.

In some embodiments according to the present inventive subject matter, the light engine assembly further comprises a lighting device housing, the lighting device housing defining a lighting device housing internal space, at least a portion of the trim element being positioned within the lighting device housing internal space. In some such embodiments, the trim element comprises a flange portion, the flange portion extending farther from an axis of the trim element than an outer surface of the lighting device housing.

In some embodiments according to the present inventive subject matter:

the internal surface of the trim element has an annular shape, the trim element defines at least a first opening and a second opening, each of the first opening and the second opening communicates with the trim element internal space, and the first opening and the second opening are located on opposite sides of the annular shape.

In some embodiments according to the present inventive subject matter:

the internal surface of the trim element has an annular shape, the trim element defines at least a first opening and a second opening, each of the first opening and the second opening communicates with the trim element internal space, and the first opening and the second opening are located on opposite sides of the annular shape. In some such embodiments, the first opening is defined by a first end region of the annular shape, and in some cases, the trim element further comprises an end element which is in contact with a second end region of the annular shape, and the second opening is defined in the end element.

In some embodiments according to the present inventive subject matter:

the internal surface of the trim element has an annular shape, and the trim element further comprises an end element which is in contact with a second end region of the annular shape, the end element closing a second end of the trim element defined by the second end region.

In some embodiments according to the present inventive subject matter:

the light engine assembly further comprises at least a first light diffuser, the light diffuser is positioned within the trim element internal space, the trim element and the first light diffuser together define a trim element-diffuser internal space, and the light engine housing is positioned within the trim element-diffuser internal space.

In some embodiments according to the third aspect of the present inventive subject matter:

the external surface of the light engine housing has an annular shape, the annular shape of the external surface of the light engine has a first end region and a second end region, the first end region and the second end region are on opposite ends of the annular shape of the external surface of the light engine, each of the light engine housing fins extends from the first end region to the second end region.

In some embodiments according to the third aspect of the present inventive subject matter, each light engine housing fin extends in a direction substantially radially away from an axis of the external surface of the light engine housing.

In some embodiments according to the third aspect of the present inventive subject matter:

the external surface of the light engine housing has an annular shape, the annular shape of the external surface of the light engine has a first end region and a second end region, the first end region and the second end region are on opposite ends of the annular shape of the external surface of the light engine, each of the light engine housing fins extends from the first end region to a location which is beyond the second end region.

The inventive subject matter may be more fully understood with reference to the accompanying drawings and the following detailed description of the inventive subject matter.

BRIEF DESCRIPTION OF THE DRAWING FIGURES

DETAILED DESCRIPTION OF THE INVENTION(S)

Figure 1:
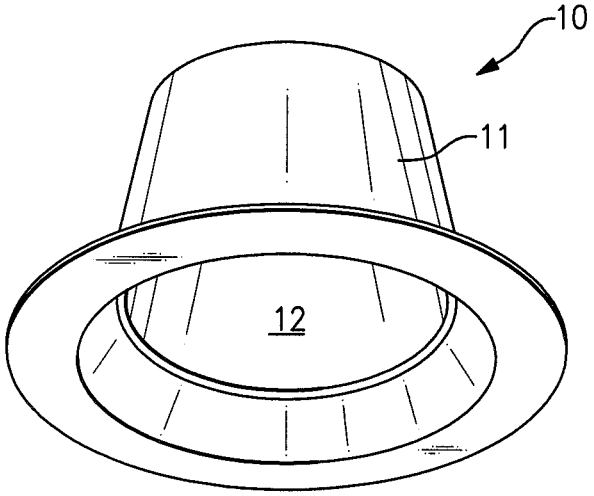
FIG. 1 is a perspective view of a first embodiment of a light engine assembly in accordance with the present inventive subject matter.

The present inventive subject matter now will be described more fully hereinafter with reference to the accompanying drawings, in which embodiments of the inventive subject matter are shown. However, this inventive subject matter should not be construed as limited to the embodiments set forth herein. Rather, these embodiments are provided so that this disclosure will be thorough and complete, and will fully convey the scope of the inventive subject matter to those skilled in the art. Like numbers refer to like elements throughout. As used herein the term "and/or" includes any and all combinations of one or more of the associated listed items.

The terminology used herein is for the purpose of describing particular embodiments only and is not intended to be limiting of the inventive subject matter. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

When an element such as a layer, region or substrate is referred to herein as being "on" or extending "onto" another element, it can be directly on or extend directly onto the other element or intervening elements may also be present. In contrast, when an element is referred to herein as being "directly on" or extending "directly onto" another element, there are no intervening elements present. Also, when an element is referred to herein as being "connected" or "coupled" to another element, it can be directly connected or coupled to the other element or intervening elements may be present. In contrast, when an element is referred to herein as being "directly connected" or "directly coupled" to another element, there are no intervening elements present.

A statement herein that two components in a device are "electrically connected," means that there are no components electrically between the components, the insertion of which materially affect the function or functions provided by the device. For example, two components can be referred to as being electrically connected, even though they may have a small resistor between them which does not materially affect the function or functions provided by the device (indeed, a wire connecting two components can be thought of as a small resistor); likewise, two components can be referred to as being electrically connected, even though they may have an additional electrical component between them which allows the device to perform an additional function, while not materially affecting the function or functions provided by a device which is identical except for not including the additional component; similarly, two components which are directly connected to each other, or which are directly connected to opposite ends of a wire or a trace on a circuit board or another medium, are electrically connected.

Although the terms "first", "second", etc. may be used herein to describe various elements, components, regions, layers, sections and/or parameters, these elements, components, regions, layers, sections and/or parameters should not be limited by these terms. These terms are only used to distinguish one element, component, region, layer or section from another region, layer or section. Thus, a first element, component, region, layer or section discussed below could be termed a second element, component, region, layer or section without departing from the teachings of the present inventive subject matter.

Furthermore, relative terms, such as "lower" or "bottom" and "upper" or "top," may be used herein to describe one element's relationship to another elements as illustrated in the Figures. Such relative terms are intended to encompass different orientations of the device in addition to the orientation depicted in the Figures. For example, if the device in the Figures is turned over, elements described as being on the "lower" side of other elements would then be oriented on "upper" sides of the other elements. The exemplary term "lower", can therefore, encompass both an orientation of "lower" and "upper," depending on the particular orientation of the figure. Similarly, if the device in one of the figures is turned over, elements described as "below" or "beneath" other elements would then be oriented "above" the other elements. The exemplary terms "below" or "beneath" can, therefore, encompass both an orientation of above and below.

The expression "in contact with", as used in the present specification (including in the preceding paragraph), means that the first structure which is "in contact with" a second structure can be in direct contact with the second structure, or can be separated from the second structure by one or more intervening structures (i.e., in indirect contact), where the first and second structures, and the one or more intervening structures each have at least one surface which is in direct contact with another surface selected from among surfaces of the first and second structures and surfaces of the one or more intervening structures. A statement that a first structure is "in contact with" a second structure encompasses situations where the first structure and the second structure are integral with one another. For example, the expression "the trim element further comprises an end element which is in contact with a second end region of the annular shape" does not exclude a device in which the end element is integral with the second end region.

The expression "illumination" (or "illuminated"), as used herein when referring to a solid state light emitter, means that at least some current is being supplied to the solid state light emitter to cause the solid state light emitter to emit at least some light. The expression "illuminated" encompasses situations where the solid state light emitter emits light continuously or intermittently at a rate such that a human eye would perceive it as emitting light continuously, or where a plurality of solid state light emitters of the same color or different colors are emitting light intermittently and/or alternatingly (with or without overlap in "on" times) in such a way that a human eye would perceive them as emitting light continuously (and, in cases where different colors are emitted, as a mixture of those colors).

The expression "excited", as used herein when referring to a lumiphor, means that at least some electromagnetic radiation (e.g., visible light, UV light or infrared light) is contacting the lumiphor, causing the lumiphor to emit at least some light. The expression "excited" encompasses situations where the lumiphor emits light continuously or intermittently at a rate such that a human eye would perceive it as emitting light continuously, or where a plurality of lumiphors of the same color or different colors are emitting light intermittently and/or alternatingly (with or without overlap in "on" times) in such a way that a human eye would perceive them as emitting light continuously (and, in cases where different colors are emitted, as a mixture of those colors).

The expression "lighting device", as used herein, is not limited, except that it indicates that the device is capable of emitting light. That is, a lighting device can be a device which illuminates an area or volume, e.g., a structure, a swimming pool or spa, a room, a warehouse, an indicator, a road, a parking lot, a vehicle, signage, e.g., road signs, a billboard, a ship, a toy, a mirror, a vessel, an electronic device, a boat, an aircraft, a stadium, a computer, a remote audio device, a remote video device, a cell phone, a tree, a window, an LCD display, a cave, a tunnel, a yard, a lamppost, or a device or array of devices that illuminate an enclosure, or a device that is used for edge or back-lighting (e.g., back light poster, signage, LCD displays), bulb replacements (e.g., for replacing AC incandescent lights, low voltage lights, fluorescent lights, etc.), lights used for outdoor lighting, lights used for security lighting, lights used for exterior residential lighting (wall mounts, post/column mounts), ceiling fixtures/wall sconces, under cabinet lighting, lamps (floor and/or table and/or desk), landscape lighting, track lighting, task lighting, specialty lighting, ceiling fan lighting, archival/art display lighting, high vibration/impact lighting—work lights, etc., mirrors/vanity lighting, or any other light emitting device.

As used herein, the term "substantially," e.g., in the expressions "substantially frustoconical", "substantially circular frustoconical", "substantially radially", "substantially conical", "substantially semi-elliptical", "substantially cylindrical," etc., means at least about 95% correspondence with the feature recited, e.g., the expression "substantially frustoconical", as used herein, means that at least 95% of the points in the surface which is characterized as being substantially frustoconical are located on one of or between a pair of imaginary frustoconical structures which are spaced from each other by a distance of not more than 5% of their largest dimension;

the expression "substantially circular frustoconical" means that at least 95% of the points in the surface which is characterized as being substantially circular frustoconical are located on one of or between a pair of imaginary frustoconical structures which are spaced from each other by a distance of not more than 5% of their largest dimension, and that x and y axis can be drawn in which at least 95% of the points on an intersection between the shape and a plane which is perpendicular to an axis of the shape have y coordinates which are within 0.95 to 1.05 times the value obtained by inserting the x coordinate into the formula $x^2+y^2=1$;

the expression "substantially radially" means that at least 95% of the points in the structure which extends "substantially radially" from an origin point define, together with the origin point, a line which defines an angle of not more than 5 degrees relative to a radial line extending through the origin point;

the expression "substantially conical", as used herein, means that at least 95% of the points in the surface which is characterized as being substantially conical are located on one of or between a pair of imaginary conical structures which are spaced from each other by a distance of not more than 5% of their largest dimension;

the expression "substantially semi-elliptical" means that a semi-ellipse can be drawn having the formula $x^2/a^2+y^2/b^2=1$, where $y \geq 0$, and imaginary axes can be drawn at a location where the y coordinate of each point on the structure is within 0.95 to 1.05 times the value obtained by inserting the x coordinate of such point into such formula; and the expression "substantially cylindrical", as used herein, means that at least 95% of the points in the surface which is characterized as being substantially cylindrical are located on one of or between a pair of imaginary cylindrical structures which are spaced from each other by a distance of not more than 5% of their largest dimension.

Unless otherwise defined, all terms (including technical and scientific terms) used herein have the same meaning as commonly understood by one of ordinary skill in the art to which this inventive subject matter belongs. It will be further understood that terms, such as those defined in commonly used dictionaries, should be interpreted as having a meaning that is consistent with their meaning in the context of the relevant art and the present disclosure and will not be interpreted in an idealized or overly formal sense unless expressly so defined herein. It will also be appreciated by those of skill in the art that references to a structure or feature that is disposed "adjacent" another feature may have portions that overlap or underlie the adjacent feature.

As noted above, in a first aspect of the present inventive subject matter, there is provided a light engine assembly comprising at least one trim element, a light engine housing, and a light engine comprising at least one solid state light emitter.

As also noted above, in a second aspect of the present inventive subject matter, there provided a light engine assembly comprising at least one trim element, a light engine housing, a light engine comprising at least one solid state light emitter, and at least one thermal interface element.

As also noted above, in a third aspect of the present inventive subject matter, there is provided a light engine assembly comprising at least one trim element, a light engine housing, a light engine comprising at least one solid state light emitter, and a plurality of light engine housing fins.

Some embodiments of the light engine assemblies according to the present inventive subject matter are designed to be installed in typical recessed housings (cans) available from major fixture manufacturers.

As noted above, in some of the embodiments of the present inventive subject matter, there is provided a trim element. The trim element in such embodiments can be of any desired shape, and can be made of any desired material, a wide variety of both of which are well-known to persons skilled in the art. Representative examples of materials out of which the trim element can be made include rolled steel, die cast aluminum, spun aluminum, liquid crystal polymer, polyphenylene sulfide (PPS), thermoset bulk molded compound or other composite materials, which provide excellent heat transfer properties, which would assist in dissipating heat.

The light engine housing can be made of any suitable material, a wide variety of which are well-known and readily available. Representative examples of materials out of which the light engine housing can be made are extruded or die cast aluminum, liquid crystal polymer, polyphenylene sulfide (PPS), thermoset bulk molded compound or other composite materials, which provide excellent heat transfer properties, which would assist in dissipating heat generated by the light engine.

The light engine housing can be any desired shape. Representative shapes for the light engine housing include cylindrical and frustoconical.

As noted above, the light engine comprises at least one solid state light emitter. In some embodiments, the light engine further comprises structure for supporting each of the at least one solid state light emitter and electrically conductive structures which carry power from at least one power source (which interfaces with the light engine) to the at least one solid state light emitter (e.g., a printed circuit board). Representative examples of suitable light engines for use according to the present inventive subject matter are described in:

U.S. Patent Application No. 60/846,222, filed on Sep. 21, 2006, entitled "LIGHTING ASSEMBLIES, METHODS OF INSTALLING SAME, AND METHODS OF REPLACING LIGHTS" (inventors: Antony Paul van de Ven and Gerald H. Negley), and U.S. patent application Ser. No. 11/859,048, filed Sep. 21, 2007 (now U.S. Patent Publication No. 2008/0084701), the entireties of which are hereby incorporated by reference; and U.S. Patent Application No. 60/853,589, filed on Oct. 23, 2006, entitled "LIGHTING DEVICES AND METHODS OF INSTALLING LIGHT ENGINE HOUSINGS AND/OR TRIM ELEMENTS IN LIGHTING DEVICE HOUSINGS" (inventors: Gary David Trott and Paul Kenneth Pickard), the entirety of which is hereby incorporated by reference.

The one or more solid state light emitter can be any suitable solid state light emitter, a wide variety of which are well-known and readily available to persons skilled in the art. Solid state light emitters include inorganic and organic light emitters. Examples of types of such light emitters include a wide variety of light emitting diodes (inorganic or organic, including polymer light emitting diodes (PLEDs)), laser diodes, thin film electroluminescent devices, light emitting polymers (LEPs), a variety of each of which are well-known in the art (and therefore it is not necessary to describe in detail such devices, and/or the materials out of which such devices are made). The expression "solid state light emitter", as used herein, can refer to a component including one or more solid state light emitters or a component including one or more solid state light emitters as well as one or more lumiphor. In some embodiments according to the present inventive subject matter, a lighting assembly includes one or more solid state light emitters which include at least one solid state light emitter and at least one lumiphor which emits light, at least a portion of such light emitted by the luminescent element being emitted in response to luminescent material in the luminescent element being excited by light emitted by the at least one solid state light emitter.

As noted above, one type of solid state light emitter which can be employed are LEDs. Such LEDs can be selected from among any light emitting diodes (a wide variety of which are readily obtainable and well known to those skilled in the art, and therefore it is not necessary to describe in detail such devices, and/or the materials out of which such devices are made).

Representative examples of such LEDs, many of which are known in the art, can include lead frames, lumiphors, encapsulant regions, etc.

Representative examples of suitable LEDs are described in:

(1) U.S. Patent Application No. 60/753,138, filed on Dec. 22, 2005, entitled "Lighting Device" (inventor: Gerald H. Negley) and U.S. patent application Ser. No. 11/614,180, filed Dec. 21, 2006 (now U.S. Patent Publication No. 2007/0236911), the entireties of which are hereby incorporated by reference;

(2) U.S. Patent Application No. 60/794,379, filed on Apr. 24, 2006, entitled "Shifting Spectral Content in LEDs by Spatially Separating Lumiphor Films" (inventors: Gerald H. Negley and Antony Paul van de Ven) and U.S. patent application Ser. No. 11/624,811, filed Jan. 19, 2007 (now U.S. Patent Publication No. 2007/0170447), the entireties of which are hereby incorporated by reference;

(3) U.S. Patent Application No. 60/808,702, filed on May 26, 2006, entitled "Lighting Device" (inventors: Gerald H. Negley and Antony Paul van de Ven) and U.S. patent application Ser. No. 11/751,982, filed May 22, 2007 (now U.S. Patent Publication No. 2007/0274080), the entireties of which are hereby incorporated by reference;

(4) U.S. Patent Application No. 60/808,925, filed on May 26, 2006, entitled "Solid State Light Emitting Device and Method of Making Same" (inventors: Gerald H. Negley and Neal Hunter) and U.S. patent application Ser. No. 11/753,103, filed May 24, 2007 (now U.S. Patent Publication No. 2007/0280624), the entireties of which are hereby incorporated by reference;

(5) U.S. Patent Application No. 60/802,697, filed on May 23, 2006, entitled "Lighting Device and Method of Making" (inventor: Gerald H. Negley) and U.S. patent application Ser. No. 11/751,990, filed May 22, 2007 (now U.S. Patent Publication No. 2007/0274063), the entireties of which are hereby incorporated by reference;

(6) U.S. Patent Application No. 60/839,453, filed on Aug. 23, 2006, entitled "LIGHTING DEVICE AND LIGHTING METHOD" (inventors: Antony Paul van de Ven and Gerald H. Negley) and U.S. patent application Ser. No. 11/843,243, filed Aug. 22, 2007 (now U.S. Patent Publication No. 2008/0084685), the entireties of which are hereby incorporated by reference;

(7) U.S. Patent Application No. 60/857,305, filed on Nov. 7, 2006, entitled "LIGHTING DEVICE AND LIGHTING METHOD" (inventors: Antony Paul van de Ven and Gerald H. Negley, the entirety of which is hereby incorporated by reference;

(8) U.S. Patent Application No. 60/851,230, filed on Oct. 12, 2006, entitled "LIGHTING DEVICE AND METHOD OF MAKING SAME" (inventor: Gerald H. Negley, the entirety of which is hereby incorporated by reference.

Some embodiments according to the present inventive subject matter include at least a first LED and at least a first lumiphor. In some such embodiments, the light emitted from the first LED has a peak wavelength in a range of from 430 nm to 480 nm, and the light emitted from the first lumiphor has a dominant wavelength in a range of from about 555 nm to about 585 nm.

Some embodiments according to the present inventive subject matter include at least a first LED, at least a first lumiphor and at least a second LED. In some such embodiments, the light emitted from the first LED has a peak wavelength in a range of from 430 nm to 480 nm, the light emitted from the first lumiphor has a dominant wavelength in a range of from about 555 nm to about 585 nm, and the light emitted from the second LED has a dominant wavelength in a range of from 600 nm to 630 nm.

Some embodiments according to the present inventive subject matter include at least a first solid state light emitter (which, in some such embodiments includes at least a first LED and at least a first lumiphor) which, if illuminated, emits light which has x, y color coordinates which define a point which is within an area on a 1931 CIE Chromaticity Diagram enclosed by first, second, third, fourth and fifth line segments, the first line segment connecting a first point to a second point, the second line segment connecting the second point to a third point, the third line segment connecting the third point to a fourth point, the fourth line segment connecting the fourth point to a fifth point, and the fifth line segment connecting the fifth point to the first point, the first point having x, y coordinates of 0.32, 0.40, the second point having x, y coordinates of 0.36, 0.48, the third point having x, y coordinates of 0.43, 0.45, the fourth point having x, y coordinates of 0.42, 0.42, and the fifth point having x, y coordinates of 0.36, 0.38.

In general, light of any number of colors can be mixed by the lighting assemblies according to the present inventive subject matter. Representative examples of blends of light colors are described in:

(1) U.S. Patent Application No. 60/752,555, filed Dec. 21, 2005, entitled "Lighting Device and Lighting Method" (inventors: Antony Paul Van de Ven and Gerald H. Negley) and U.S. patent application Ser. No. 11/613,714, filed Dec. 20, 2006 (now U.S. Patent Publication No. 2007/0139920), the entireties of which are hereby incorporated by reference;

(2) U.S. Patent Application No. 60/752,556, filed on Dec. 21, 2005, entitled "SIGN AND METHOD FOR LIGHTING" (inventors: Gerald H. Negley and Antony Paul van de Ven) and U.S. patent application Ser. No. 11/613,733, filed Dec. 20, 2006 (now U.S. Patent Publication No. 2007/0137074), the entireties of which are hereby incorporated by reference;

(3) U.S. Patent Application No. 60/793,524, filed on Apr. 20, 2006, entitled "LIGHTING DEVICE AND LIGHTING METHOD" (inventors: Gerald H. Negley and Antony Paul van de Ven) and U.S. patent application Ser. No. 11/736,761, filed Apr. 18, 2007 (now U.S. Patent Publication No. 2007/0278934), the entireties of which are hereby incorporated by reference;

(4) U.S. Patent Application No. 60/793,518, filed on Apr. 20, 2006, entitled "LIGHTING DEVICE AND LIGHTING METHOD" (inventors: Gerald H. Negley and Antony Paul van de Ven) and U.S. patent application Ser. No. 11/736,799, filed Apr. 18, 2007 (now U.S. Patent Publication No. 2007/0267983), the entireties of which are hereby incorporated by reference;

(5) U.S. Patent Application No. 60/793,530, filed on Apr. 20, 2006, entitled "LIGHTING DEVICE AND LIGHTING METHOD" (inventors: Gerald H. Negley and Antony Paul van de Ven) and U.S. patent application Ser. No. 11/737,321, filed Apr. 19, 2007 (now U.S. Patent Publication No. 2007/0278503), the entireties of which are hereby incorporated by reference;

(6) U.S. Pat. No. 7,213,940, issued on May 8, 2007, entitled "LIGHTING DEVICE AND LIGHTING METHOD" (inventors: Antony Paul van de Ven and Gerald H. Negley), the entirety of which is hereby incorporated by reference;

(7) U.S. Patent Application No. 60/868,134, filed on Dec. 1, 2006, entitled "LIGHTING DEVICE AND LIGHTING METHOD" (inventors: Antony Paul van de Ven and Gerald H. Negley), the entirety of which is hereby incorporated by reference;

(8) U.S. Patent Application No. 60/868,986, filed on Dec. 7, 2006, entitled "LIGHTING DEVICE AND LIGHTING METHOD" (inventors: Antony Paul van de Ven and Gerald H. Negley), the entirety of which is hereby incorporated by reference;

(9) U.S. Patent Application No. 60/857,305, filed on Nov. 7, 2006, entitled "LIGHTING DEVICE AND LIGHTING METHOD" (inventors: Antony Paul van de Ven and Gerald H. Negley, the entirety of which is hereby incorporated by reference; and

(10) U.S. Patent Application No. 60/891,148, filed on Feb. 22, 2007, entitled "LIGHTING DEVICE AND METHODS OF LIGHTING, LIGHT FILTERS AND METHODS OF FILTERING LIGHT" (inventor: Antony Paul van de Ven, the entirety of which is hereby incorporated by reference.

The lighting assemblies according to the present inventive subject matter can comprise any desired number of solid state emitters. For example, a lighting assembly according to the present inventive subject matter can include one light emitting diode, or can include 50 or more light emitting diodes, or can include 100 or more light emitting diodes, etc.

As indicated above, some embodiments of the lighting assemblies according to the present inventive subject matter can include lumiphors (i.e., luminescence region or luminescent element which comprises at least one luminescent material). The expression "lumiphor", as used herein, refers to any luminescent element, i.e., any element which includes a luminescent material.

A wide variety of luminescent materials (also known as lumiphors or luminophoric media, e.g., as disclosed in U.S. Pat. No. 6,600,175, the entirety of which is hereby incorporated by reference) are well-known and available to persons of skill in the art. For example, a phosphor is a luminescent material that emits a responsive radiation (e.g., visible light) when excited by a source of exciting radiation. In many instances, the responsive radiation has a wavelength which is different from the wavelength of the exciting radiation. Other examples of luminescent materials include scintillators, day glow tapes and inks which glow in the visible spectrum upon illumination with ultraviolet light.

Luminescent materials can be categorized as being down-converting, i.e., a material which converts photons to a lower energy level (longer wavelength) or up-converting, i.e., a material which converts photons to a higher energy level (shorter wavelength).

Inclusion of luminescent materials in LED devices has been accomplished by adding the luminescent materials to a clear encapsulant material (e.g., epoxy-based, silicone-based, glass-based or metal oxide-based material) as discussed above, for example by a blending or coating process.

For example, U.S. Pat. No. 6,963,166 (Yano '166) discloses that a conventional light emitting diode lamp includes a light emitting diode chip, a bullet-shaped transparent housing to cover the light emitting diode chip, leads to supply current to the light emitting diode chip, and a cup reflector for reflecting the emission of the light emitting diode chip in a uniform direction, in which the light emitting diode chip is encapsulated with a first resin portion, which is further encapsulated with a second resin portion. According to Yano '166, the first resin portion is obtained by filling the cup reflector with a resin material and curing it after the light emitting diode chip has been mounted onto the bottom of the cup reflector and then has had its cathode and anode electrodes electrically connected to the leads by way of wires. According to Yano '166, a phosphor is dispersed in the first resin portion so as to be excited with the light A that has been emitted from the light emitting diode chip, the excited phosphor produces fluorescence ("light B") that has a longer wavelength than the light A, a portion of the light A is transmitted through the first resin portion including the phosphor, and as a result, light C, as a mixture of the light A and light B, is used as illumination.

The lighting devices of the present inventive subject matter can be supplied with electricity in any desired manner. Skilled artisans are familiar with a wide variety of power supplying apparatuses, and any such apparatuses can be employed in connection with the present inventive subject matter. The lighting devices of the present inventive subject matter can be electrically connected (or selectively connected) to any desired power source, persons of skill in the art being familiar with a variety of such power sources.

In addition, any desired circuitry can be employed in order to supply energy to the lighting devices according to the present inventive subject matter. Representative examples of circuitry which may be used in practicing the present inventive subject matter is described in:

(1) U.S. Patent Application No. 60/752,753, filed on Dec. 21, 2005, entitled "Lighting Device" (inventors: Gerald H. Negley, Antony Paul van de Ven and Neal Hunter) and U.S. patent application Ser. No. 11/613,692, filed Dec. 20, 2006 (now U.S. Patent Publication No. 2007/0139923), the entireties of which are hereby incorporated by reference;

(2) U.S. Patent Application No. 60/798,446, filed on May 5, 2006, entitled "Lighting Device" (inventor: Antony Paul van de Ven) and U.S. patent application Ser. No. 11/743,754, filed May 3, 2007 (now U.S. Patent Publication No. 2007/0263393), the entireties of which are hereby incorporated by reference;

(3) U.S. Patent Application No. 60/809,959, filed on Jun. 1, 2006, entitled "Lighting Device With Cooling" (inventors: Thomas G. Coleman, Gerald H. Negley and Antony Paul van de Ven) and U.S. patent application Ser. No. 11/626,483, filed Jan. 24, 2007 (now U.S. Patent Publication No. 2007/0171145), the entireties of which are hereby incorporated by reference;

(4) U.S. Patent Application No. 60/809,595, filed on May 31, 2006, entitled "LIGHTING DEVICE AND METHOD OF LIGHTING" (inventor: Gerald H. Negley) and U.S. patent application Ser. No. 11/755,162, filed May 30, 2007 (now U.S. Patent Publication No. 2007/0279440), the entireties of which are hereby incorporated by reference;

(5) U.S. Patent Application No. 60/844,325, filed on Sep. 13, 2006, entitled "BOOST/FLYBACK POWER SUPPLY TOPOLOGY WITH LOW SIDE MOSFET CURRENT CONTROL" (inventor: Peter Jay Myers), and U.S. patent application Ser. No. 11/854,744, filed Sep. 13, 2007 (now U.S. Patent Publication No. 2008/0088248), the entireties of which are hereby incorporated by reference.

The thermal interface element can be made of any suitable material, a wide variety of which are well-known and readily available. Representative examples of a suitable heat transfer materials include thermal epoxy, thermal grease and gap pads, suitable varieties of each of which are well-known by and readily available to persons skilled in the art.

The light engine housing fins can be of any desired shape, and can be made of any suitable material, a wide variety of which are well-known and readily available. Representative examples of materials out of which the light engine housing can be made are extruded or die cast aluminum, liquid crystal polymer, polyphenylene sulfide (PPS), thermoset bulk molded compound or other composite materials, which provide excellent heat transfer properties, which would assist in dissipating heat generated by the light engine. In some embodiments, the light engine housing fins are integral with the light engine housing.

As noted above, in some embodiments according to the present inventive subject matter, there is further provided a lighting device housing.

The lighting device housing, when included, can be formed of any material which can be molded and/or shaped, a wide variety of which are well-known and readily available. Preferably, the lighting device housing is formed of a material which is an effective heat sink (i.e., which has high thermal conductivity and/or high heat capacity) and/or which is reflective (or which is coated with a reflective material). A representative example of a material out of which the lighting device housing can be made is rolled steel.

The lighting device housing can be any desired shape. A representative shape for the lighting device housing is hollow cylindrical, e.g., as in conventional "can" light fixtures. Other representative shapes include hollow conical (or substantially conical), hollow frustoconical (or substantially frustoconical) and hollow semi-elliptical (or substantially semi-elliptical), or any shape which includes one or more portions which are individually selected from among hollow conical (or substantially conical), hollow frustoconical (or substantially frustoconical), hollow cylindrical (or substantially cylindrical) and hollow semi-elliptical (or substantially semi-elliptical).

For example, fixtures, other mounting structures and complete lighting assemblies which may be used in practicing the present inventive subject matter are described in:

(1) U.S. Patent Application No. 60/752,753, filed on Dec. 21, 2005, entitled "Lighting Device" (inventors: Gerald H. Negley, Antony Paul van de Ven and Neal Hunter) and U.S. patent application Ser. No. 11/613,692, filed Dec. 20, 2006 (now U.S. Patent Publication No. 2007/0139923), the entireties of which are hereby incorporated by reference;

(2) U.S. Patent Application No. 60/798,446, filed on May 5, 2006, entitled "Lighting Device" (inventor: Antony Paul van de Ven) and U.S. patent application Ser. No. 11/743,754, filed May 3, 2007 (now U.S. Patent Publication No. 2007/0263393), the entireties of which are hereby incorporated by reference;

(3) U.S. Patent Application No. 60/845,429, filed on Sep. 18, 2006, entitled "LIGHTING DEVICES, LIGHTING ASSEMBLIES, FIXTURES AND METHODS OF USING SAME" (inventor: Antony Paul van de Ven), and U.S. patent application Ser. No. 11/856,421, filed Sep. 17, 2007 (now U.S. Patent Publication No. 2008/0084700), the entireties of which are hereby incorporated by reference;

(4) U.S. Patent Application No. 60/846,222, filed on Sep. 21, 2006, entitled "LIGHTING ASSEMBLIES, METHODS OF INSTALLING SAME, AND METHODS OF REPLACING LIGHTS" (inventors: Antony Paul van de Ven and Gerald H. Negley), and U.S. patent application Ser. No. 11/859,048, filed Sep. 21, 2007 (now U.S. Patent Publication No. 2008/0084701), the entireties of which are hereby incorporated by reference;

(5) U.S. Patent Application No. 60/809,618, filed on May 31, 2006, entitled "LIGHTING DEVICE AND METHOD OF LIGHTING" (inventors: Gerald H. Negley, Antony Paul van de Ven and Thomas G. Coleman) and U.S. patent application Ser. No. 11/755,153, filed May 30, 2007 (now U.S. Patent Publication No. 2007/0279903), the entireties of which are hereby incorporated by reference;

(6) U.S. Patent Application No. 60/858,881, filed on Nov. 14, 2006, entitled "LIGHT ENGINE ASSEMBLIES" (inventors: Paul Kenneth Pickard and Gary David Trott), the entirety of which is hereby incorporated by reference;

(7) U.S. Patent Application No. 60/859,013, filed on Nov. 14, 2006, entitled "LIGHTING ASSEMBLIES AND COMPONENTS FOR LIGHTING ASSEMBLIES" (inventors: Gary David Trott and Paul Kenneth Pickard) and U.S. patent application Ser. No. 11,939,059, filed Nov. 13, 2007 (now U.S. Patent Publication No. 2008/0112170), the entireties of which are hereby incorporated by reference;

(8) U.S. Patent Application No. 60/853,589, filed on Oct. 23, 2006, entitled "LIGHTING DEVICES AND METHODS OF INSTALLING LIGHT ENGINE HOUSINGS AND/OR TRIM ELEMENTS IN LIGHTING DEVICE HOUSINGS" (inventors: Gary David Trott and Paul Kenneth Pickard), the entirety of which is hereby incorporated by reference;

(9) U.S. Patent Application No. 60/861,901, filed on Nov. 30, 2006, entitled "LED DOWNLIGHT WITH ACCESSORY ATTACHMENT" (inventors: Gary David Trott, Paul Kenneth Pickard and Ed Adams), the entirety of which is hereby incorporated by reference; and

(10) U.S. Patent Application No. 60/916,384, filed on May 7, 2007, entitled "LIGHT FIXTURES, LIGHTING DEVICES, AND COMPONENTS FOR THE SAME" (inventors: Paul Kenneth Pickard, Gary David Trott and Ed Adams), the entirety of which is hereby incorporated by reference.

As noted above, in some embodiments according to the present inventive subject matter, there is further provided at least a first light diffuser.

Any desired light diffuser can be employed, if desired, and persons skilled in the art are familiar with and have easy access to a variety of such diffusers. In some embodiments of the present inventive subject matter, a diffuser is mounted on the lighting device housing below the light engine housing, whereby light emitted from the light engine passes through the diffuser and is diffused prior to exiting the lighting device into the region that will be illuminated by the lighting device, e.g., into a room. Alternatively or additionally, the lighting devices according to the present inventive subject matter can include a reflective element. Any desired reflective element can be employed, and persons skilled in the art are familiar with and have easy access to a variety of such reflective elements. A representative example of a suitable material out of which the reflective element can be made is a material marketed by Furukawa (a Japanese corporation) under the trademark MCPET®. In some embodiments of the present inventive subject matter, a reflective element is shaped and is positioned so as to cover at least part of the internal surface of the sidewall of the lighting device housing. In some embodiments of the present inventive subject matter, a diffuser is provided and is mounted on the lighting device housing below the light engine housing, and a reflective element is provided and is mounted so as to cover the internal surface of the sidewall of the lighting device housing below the diffuser.

The present inventive subject matter further relates to an illuminated enclosure (the volume of which can be illuminated uniformly or non-uniformly), comprising an enclosed space and at least one lighting device according to the present inventive subject matter, wherein the lighting device illuminates at least a portion of the enclosure (uniformly or non-uniformly).

The present inventive subject matter is further directed to an illuminated surface, comprising a surface and at least one lighting device as described herein, wherein if the lighting device is illuminated, the lighting device would illuminate at least a portion of the surface.

The present inventive subject matter is further directed to an illuminated area, comprising at least one item, e.g., selected from among the group consisting of a structure, a swimming pool or spa, a room, a warehouse, an indicator, a road, a parking lot, a vehicle, signage, e.g., road signs, a billboard, a ship, a toy, a mirror, a vessel, an electronic device, a boat, an aircraft, a stadium, a computer, a remote audio device, a remote video device, a cell phone, a tree, a window, an LCD display, a cave, a tunnel, a yard, a lamppost, etc., having mounted therein or thereon at least one lighting device as described herein.

Embodiments in accordance with the present inventive subject matter are described herein with reference to cross-sectional (and/or plan view) illustrations that are schematic illustrations of idealized embodiments of the present inventive subject matter. As such, variations from the shapes of the illustrations as a result, for example, of manufacturing techniques and/or tolerances, are to be expected. Thus, embodiments of the present inventive subject matter should not be construed as limited to the particular shapes of regions illustrated herein but are to include deviations in shapes that result, for example, from manufacturing. For example, a molded region illustrated or described as a rectangle will, typically, have rounded or curved features. Thus, the regions illustrated in the figures are schematic in nature and their shapes are not intended to illustrate the precise shape of a region of a device and are not intended to limit the scope of the present inventive subject matter.

Figure 9:
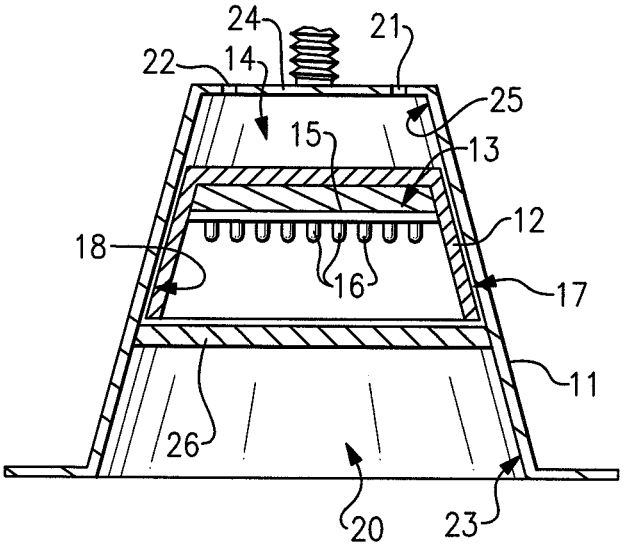
FIG. 9 is a cross-sectional view of the first embodiment depicted in FIG. 1.

FIG. 1 is a perspective view of a first embodiment of a light engine assembly in accordance with the present inventive subject matter. Referring to FIG. 1, there is shown a light engine assembly 10 comprising a trim element 11. Referring to FIG. 9, which is a cross-sectional view of the first embodiment, the trim element 11, a light engine housing 12 and a light engine 13 are visible. The trim element 11 defines a trim element internal space 14.

The light engine housing 12 is positioned within the trim element internal space 14. The light engine housing 12 defines a light engine housing internal space 15.

The light engine 13 is positioned within the light engine housing internal space 15 and comprises a plurality of LEDs 16.

An external surface 17 of the light engine housing 12 is in contact with an internal surface 18 of the trim element 11.

Figure 2:
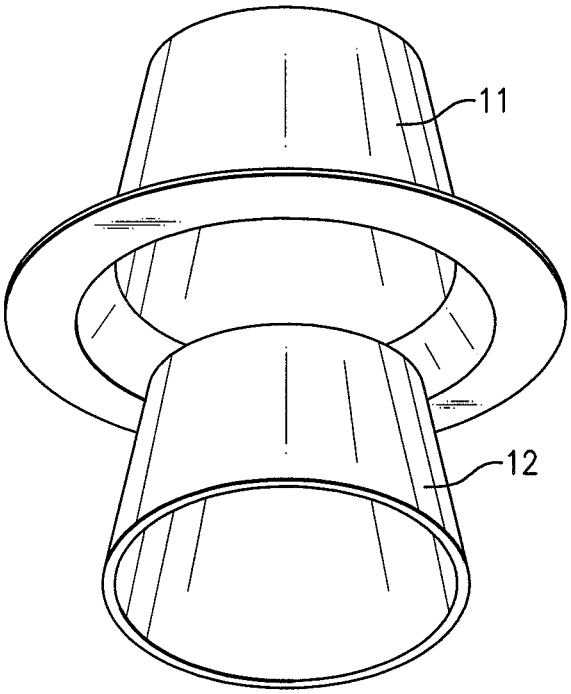
FIG. 2 is a perspective exploded view of the first embodiment depicted in FIG. 1.

As shown in FIG. 2, the external surface 17 of the light engine housing 12 and the internal surface 18 of the trim element 11 are each substantially frustoconical. The expression "frustoconical", as used herein, means a shape which has an axis, and in which sections of the shape in planes perpendicular to the axis which cut through the shape and are spaced along the axis have similar shape and increase in size in one direction along the axis. In the embodiment depicted in FIG. 2, the frustoconical shape has an axis, and sections of the shape defined perpendicular to the axis are circular and increase in size in the upward direction in the orientation depicted in FIG. 2, i.e., the trim element 11 and the light engine housing 12 both have a circular frustoconical shape.

As shown in FIG. 1, the internal surface of the trim element 11 has an annular shape. The expression "annular shape" as used herein means ring-like, where a section of the ring (defined perpendicular to an axis of the ring) can be any shape. In the device shown in FIG. 1, the internal surface of the trim element 11 is circular annular, i.e., a section defined perpendicular to the axis of the internal surface of the trim element 11 would be substantially circular.

Referring to FIG. 9, the trim element 11 defines at least a first opening 20, a second opening 21 and a third opening 22. The first opening 20, the second opening 21 and the third opening 22 each communicate with the trim element internal space 14, and the first opening 20 and the second opening 21 are located on opposite sides of the annular shape (as are the first opening 20 and the third opening 22). The first opening 20 is defined by a first end region 23 of the annular shape. The trim element 11 further comprises an end element 24 which is in contact with a second end region 25 of the annular shape, and the second opening 21 and the third opening 22 are defined in the end element 24 (in alternative embodiments, the end element has no openings, and it completely closes the second end of the trim element defined by the second end region).

The first embodiment further comprises a light diffuser 26 positioned within the trim element internal space 14, the trim element 11 and the light diffuser 26 together defining a trim element-diffuser internal space in which the light engine housing 12 is positioned.

The first embodiment thus provides a light engine housing with smooth sides. The trim element is designed with an upper section profile that creates a very tight force-fit when the light engine housing is installed in the trim element, in order to enable effective heat transfer between the two parts. The trim element may be designed with an open top or an enclosed top that would increase the surface area of conduction. Mechanical fastening (e.g., screws, not shown) between the light engine housing and the trim element can be included in order to provide retention and mating pressure.

The first embodiment also comprises an electrical connection region which is engageable in an electrical receptacle—in this embodiment, the electrical connection region is in the form of a screw-threaded portion which can be screwed into an Edison socket. Alternatively, any desired electrical connection region, for engagement with any suitable electrical receptacle can be employed in accordance with the present inventive subject matter, and persons of skill in the art are aware of, and have ready access to, a wide variety of such electrical connection regions and electrical receptacles.

As noted above, FIG. 2 is a perspective exploded view of the first embodiment depicted in FIG. 1.

Figure 3:
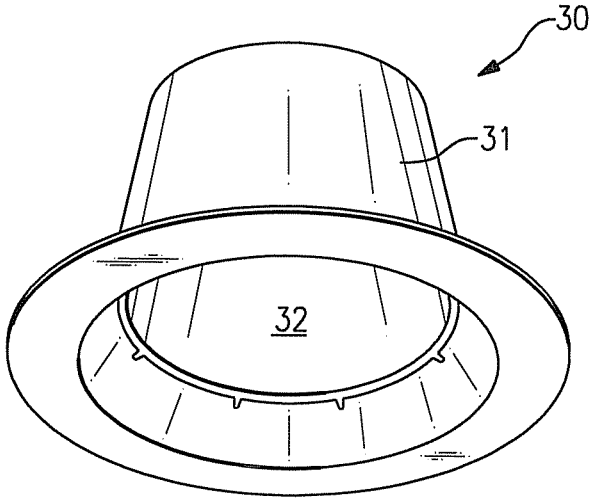
FIG. 3 is a perspective view of a second embodiment of a light engine assembly in accordance with the present inventive subject matter.

FIG. 3 is a perspective view of a second embodiment of a light engine assembly in accordance with the present inventive subject matter.

Figure 12:
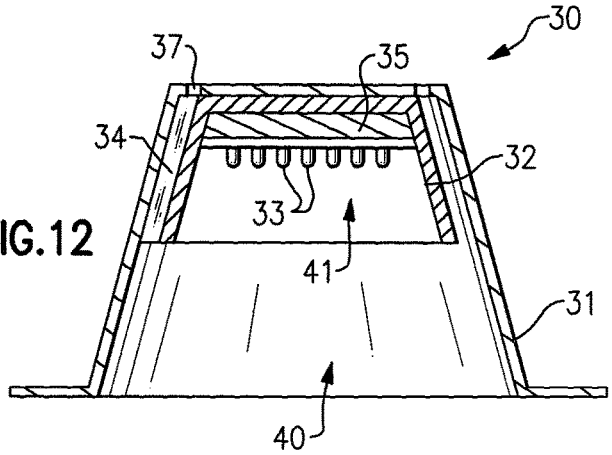
FIG. 12 is a cross-sectional view of the second embodiment depicted in FIG. 3.

FIG. 12 is a cross-sectional view of the second embodiment depicted in FIG. 3. Referring to FIG. 12, there is shown a light engine assembly 30 comprising a trim element 31, a light engine housing 32, a light engine 35 comprising a plurality of LEDs 33, and a plurality of light engine housing fins 34. In this embodiment, the light engine housing fins 34 are integral with the light engine housing 32 (alternatively, some or all of the fins 34 could be integral with the trim element 31, and/or only some of the fins 34 could be integral with the light engine housing). The trim element 31 defines a trim element internal space 40 in which the light engine housing 32 is positioned. The light engine housing 32 defines a light engine housing internal space 41 in which the light engine 35 is positioned. In this embodiment, each of the light engine housing fins 34 is in contact with an external surface of the light engine housing 32 and is in contact with an internal surface of the trim element 31 (alternatively, some or all of the fins 34 could be not in contact with the trim element 31, and/or some or all of the fins could be not in contact with the light engine housing 32). Each of the light engine housing fins 34 is outside of the light engine housing internal space and inside of the trim element internal space.

Figure 4:
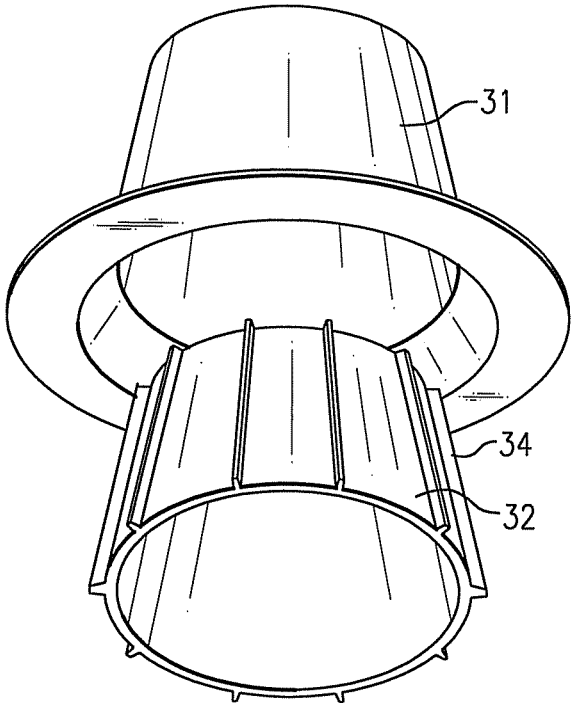
FIG. 4 is a perspective exploded view of the second embodiment depicted in FIG. 3.

FIG. 4 is a perspective exploded view of the second embodiment depicted in FIG. 3.

Figure 5:
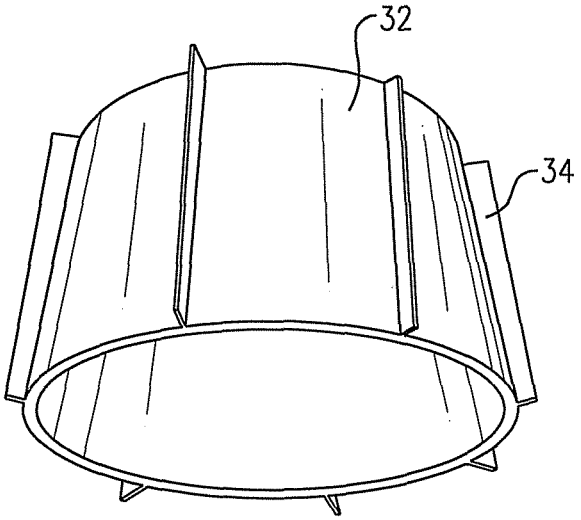
FIG. 5 is a perspective view of the light engine housing with integral fins in the light engine assembly of the second embodiment depicted in FIG. 3.

FIG. 5 is a perspective view of the light engine housing with integral fins in the light engine assembly of the second embodiment depicted in FIG. 3.

Figure 6:
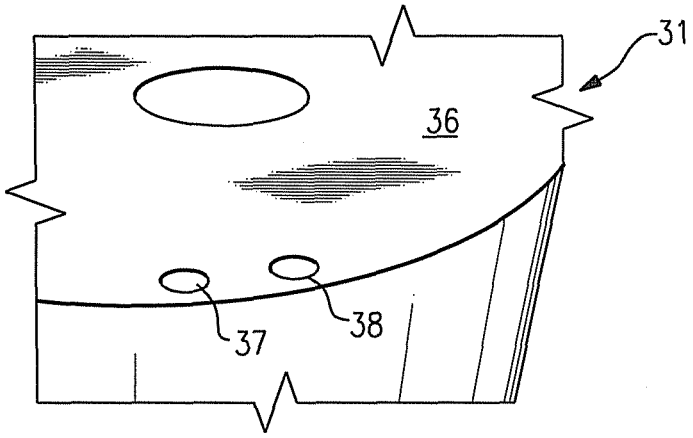
FIG. 6 is a partial perspective view of the trim element in the light engine assembly of the second embodiment depicted in FIG. 3.

FIG. 6 is a partial perspective view of the trim element in the light engine assembly of the second embodiment depicted in FIG. 3. The trim element 31 comprises an end element 36, and the openings 37 and 38 are defined in the end element 36.

Referring to FIGS. 3-5, the external surface of the light engine housing 32 has an annular shape which has, on opposite ends thereof, a first end region and a second end region. Each of the light engine housing fins 34 extends from the first end region to the second end region of the annular shape of the light engine housing 32. Each light engine housing fin 34 extends in a direction substantially radially away from an axis of the external surface of the light engine housing 32.

The second embodiment thus comprises a light engine housing which has fins along its sides to increase the surface area for heat dissipation. In this embodiment, the trim element 31 is mechanically attached to the top (in the orientation shown in FIGS. 3-5) of the light engine housing 32 with at least one thermal interface element to increase heat conduction. The trim element 31 is configured so as to allow airflow from the room and along the fins. The openings in the trim element (e.g., openings 37 and 38 in FIG. 6) are positioned around the periphery of the trim, and preferably are aligned with the gaps between the fins to allow for convective heat transfer to the room-side air, even where the assembly is mounted within an "airtight" recessed light can. In situations where the assembly is mounted in a non-airtight can with airflow in the plenum, e.g., in commercial applications, even greater heat dissipation can be provided.

Figure 7:
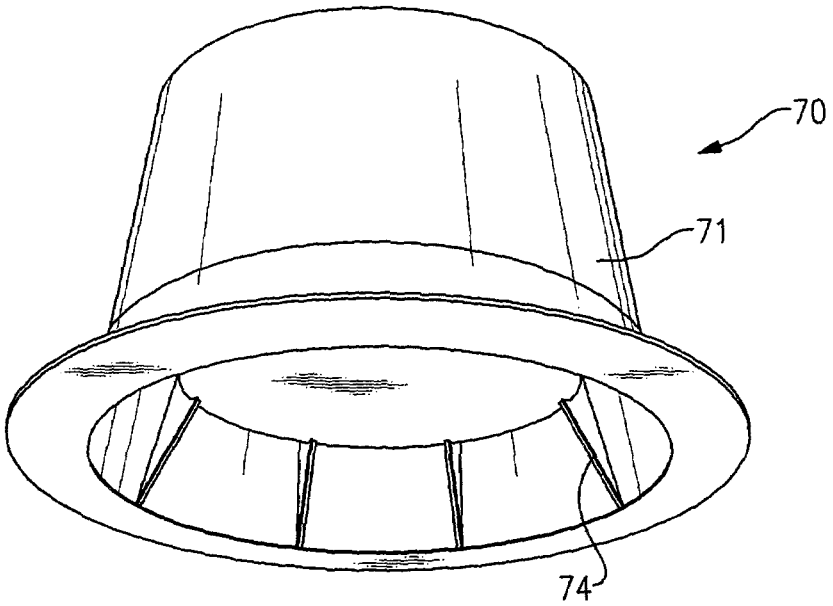
FIG. 7 is a perspective view of a third embodiment of a light engine assembly in accordance with the present inventive subject matter.
Figure 8:
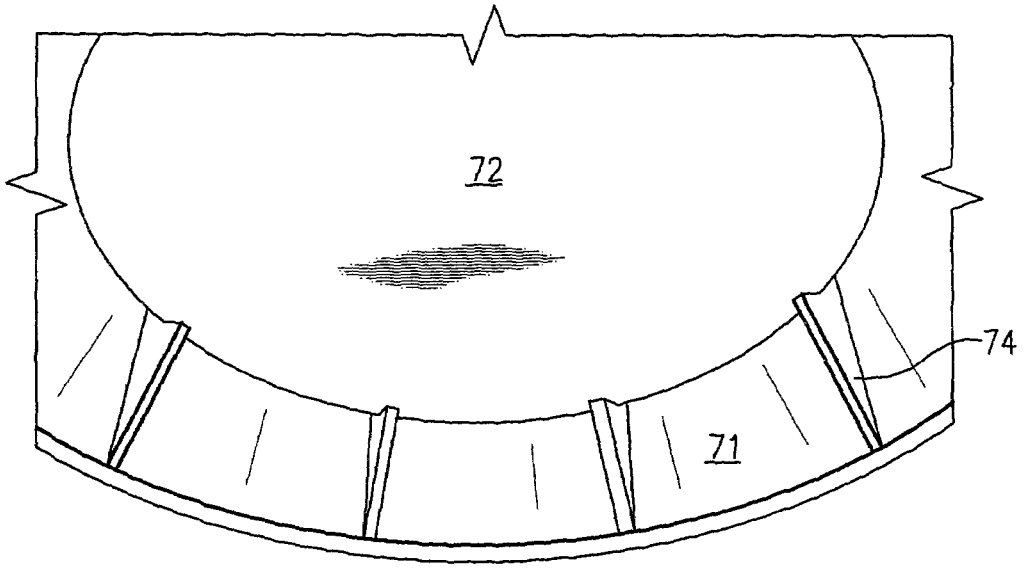
FIG. 8 is a close-up perspective view of a portion of the third embodiment depicted in FIG. 7.

FIG. 7 is a perspective view of a third embodiment of a light engine assembly in accordance with the present inventive subject matter.

Figure 13:
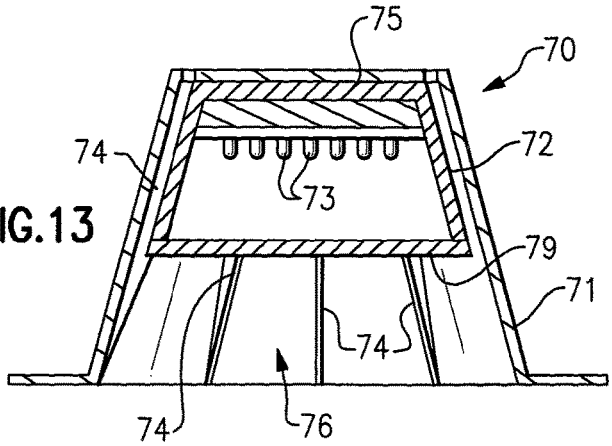
FIG. 13 is a cross-sectional view of the third embodiment depicted in FIG. 7.

FIG. 13 is a cross-sectional view of the third embodiment depicted in FIG. 7. Referring to FIG. 13, there is shown a light engine assembly 70 comprising a trim element 71, a light engine housing 72, a light engine 75 comprising a plurality of LEDs 73, and a plurality of light engine housing fins 74. In this embodiment, the light engine housing fins 74 are integral with the light engine housing 72 (alternatively, some or all of the fins 74 could be integral with the trim element 71, and/or only some of the fins 74 could be integral with the light engine housing). The trim element 71 defines a trim element internal space 76 in which the light engine housing 72 is positioned. The light engine housing 72 defines a light engine housing internal space in which the light engine 75 is positioned. In this embodiment, each of the light engine housing fins 74 is in contact with an external surface of the light engine housing 72 and is in contact with an internal surface of the trim element 71 (alternatively, some or all of the fins 74 could be not in contact with the trim element 71, and/or some or all of the fins could be not in contact with the light engine housing 72). Each of the light engine housing fins 74 is outside of the light engine housing internal space and inside of the trim element internal space.

The external surface of the light engine housing 72 has an annular shape which has, on opposite ends thereof, a first end region and a second end region. Each of the light engine housing fins 74 extends from the first end region to a location which is beyond the second end region of the annular shape of the light engine housing 72. Each light engine housing fin 74 extends in a direction substantially radially away from an axis of the external surface of the light engine housing 72.

The third embodiment further comprises a light diffuser 79 positioned within the trim element internal space 76, the trim element 71 and the light diffuser 79 together defining a trim element-diffuser internal space in which the light engine housing 72 is positioned.

The third embodiment thus comprises a light engine housing which has fins along its sides which extend below the bottom of the diffuser to increase the surface area and interaction with the room-air. The fins are functional and can also provide an ornamental effect by creating a unique downlight aesthetic. Various extension lengths and shapes can be provided with curved and/or straight profiles to provide a wide variety of ornamental effects. Ribs, bumps or "stair steps" (among other possibilities) can be added to the interior surface of the extended heat fins to catch light and provide additional visual detail. Alternatively or additionally, some or all of the fins can be covered by a decorative trim structure that would create a typical downlight trim appearance to the room but which would allow airflow behind.

Figure 10:
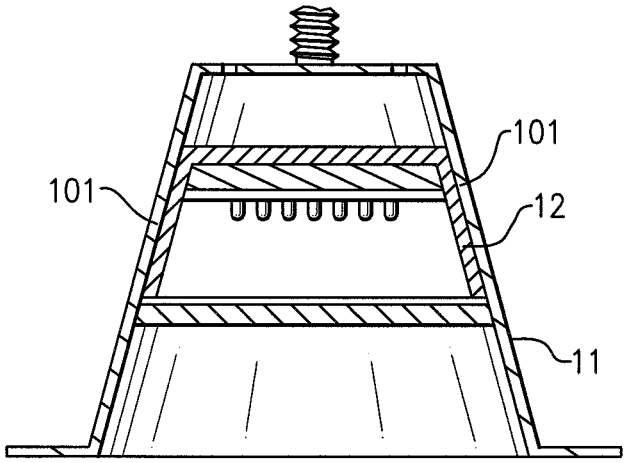
FIG. 10 is a cross-sectional view of a fourth embodiment of a lighting device in accordance with the present inventive subject matter.

FIG. 10 is a sectional view of a fourth embodiment of a lighting device in accordance with the present inventive subject matter. The fourth embodiment is similar to the first embodiment (see FIG. 9), except that in the fourth embodiment, a thermal interface element 101 is positioned between the light engine housing 12 and the trim element 11.

Figure 11:
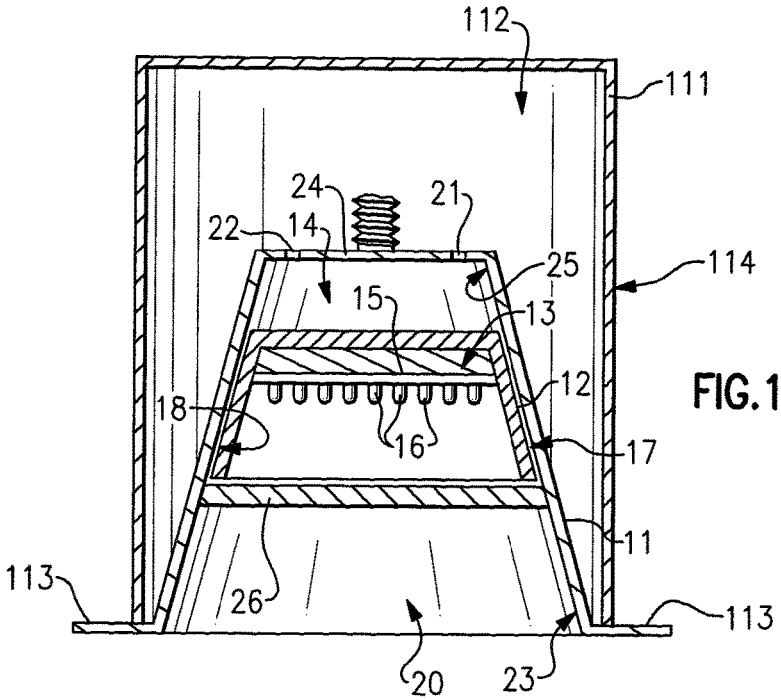
FIG. 11 is a cross-sectional view of a fifth embodiment of a light engine assembly in accordance with the present inventive subject matter.

FIG. 11 is a sectional view of a fifth embodiment of a light engine assembly in accordance with the present inventive subject matter. The fifth embodiment is similar to the first embodiment, but the fifth embodiment further comprises a lighting device housing 111. Referring to FIG. 11, the lighting device housing 111 defines a lighting device housing internal space 112. A portion of the trim element 11 is positioned within the lighting device housing internal space 112.

As also shown in FIG. 11, the trim element 11 comprises a flange portion 113. The flange portion 113 extends farther from an axis of the trim element 11 than an outer surface 114 of the lighting device housing 111.

Any two or more structural parts of the light engine assemblies described herein can be integrated. Any structural part of the light engine assemblies described herein can be provided in two or more parts (which are held together, if necessary).

Furthermore, while certain embodiments of the present inventive subject matter have been illustrated with reference to specific combinations of elements, various other combinations may also be provided without departing from the teachings of the present inventive subject matter. Thus, the present inventive subject matter should not be construed as being limited to the particular exemplary embodiments described herein and illustrated in the Figures, but may also encompass combinations of elements of the various illustrated embodiments.

Many alterations and modifications may be made by those having ordinary skill in the art, given the benefit of the present disclosure, without departing from the spirit and scope of the inventive subject matter. Therefore, it must be understood that the illustrated embodiments have been set forth only for the purposes of example, and that it should not be taken as limiting the inventive subject matter as defined by the following claims. The following claims are, therefore, to be read to include not only the combination of elements which are literally set forth but all equivalent elements for performing substantially the same function in substantially the same way to obtain substantially the same result. The claims are thus to be understood to include what is specifically illustrated and described above, what is conceptually equivalent, and also what incorporates the essential idea of the inventive subject matter.

The invention claimed is:

1. A light engine assembly, comprising:
at least one exterior element;
at least one interior element;
at least first and second heat dissipation fins; and
a light engine,
the exterior element having at least an exterior element first surface and an exterior element second surface,
the interior element having at least an interior element first surface and an interior element second surface,
at least a first portion of the exterior element second surface spaced radially from at least a first portion of the interior element first surface,
the first heat dissipation fin in contact with the first portion of the exterior element second surface and with the first portion of the interior element first surface,
the second heat dissipation fin in contact with the first portion of the exterior element second surface and with the first portion of the interior element first surface,
at least a first portion of the exterior element first surface substantially frustoconical,
the light engine within a first space defined by the exterior element second surface,
the light engine comprising at least a first solid state light emitter,
a second space defined by the exterior element, the interior element, the first heat dissipation fin and the second heat dissipation fin,
air able to enter the second space through a first opening at a first end of the second space and exit the second space through a second opening at a second end of the second space.

2. A light engine assembly as recited in claim 1, wherein:
the light engine assembly comprises a plurality of heat dissipation fins comprising at least the first and second heat dissipation fins, and
in a section along a first plane:
a cross-section of the exterior element is a first substantially circular shape,
a cross-section of the interior element is a second substantially circular shape,
a cross-section of each of the heat dissipation fins extends from the interior element to the exterior element,
the heat dissipation fins are spaced circumferentially relative to the first and second substantially circular shapes.

3. A light engine assembly as recited in claim 2, wherein:
the light engine assembly comprises at least eight heat dissipation fins, and
each heat dissipation fin is spaced circumferentially from at least one other heat dissipation fin by not more than 45 degrees.

4. A light engine assembly as recited in claim 1, wherein the light engine is within a third space defined by the interior element second surface.

* * * * *